United States Patent [19]

Underwood

[11] 4,201,311

[45] May 6, 1980

[54] CONTAINER AND LID OF MOLDED PLASTIC MATERIAL

[76] Inventor: J. Larry Underwood, 104 Dixie Dr., Woodstock, Ga. 30188

[21] Appl. No.: 917,588

[22] Filed: Jun. 21, 1978

[51] Int. Cl.[2] ..... B65D 43/10

[52] U.S. Cl. ..... 220/307; 220/306; 220/354; 220/355; 220/356

[58] Field of Search ..... 220/229, 284, 285, 286, 220/307, 306, DIG. 6, 354, 355, 356

[56] References Cited

U.S. PATENT DOCUMENTS

| | | | |
|---|---|---|---|
| 1,157,041 | 10/1915 | Reynolds | 220/307 |
| 3,046,853 | 7/1962 | Legendre | 220/284 |
| 3,149,747 | 9/1964 | Burgess | 220/306 |
| 3,589,552 | 6/1971 | Fitzgerald | 220/307 |
| 3,902,628 | 9/1975 | Schurman | 220/306 |
| 3,966,074 | 6/1976 | Hotchkiss et al. | 220/306 |
| 4,112,979 | 9/1978 | Widdicombe | 220/306 |

*Primary Examiner*—Joseph Man-Fu Moy

*Attorney, Agent, or Firm*—Quaintance, Murphy & Richardson

[57] ABSTRACT

A container and lid of molded plastic material having a fastener structure integral with the container and lid to connect the lid onto the container. The fastener comprises two complementary series of element, one projecting axially upwardly on the wall of the container, the other downwardly on the rim of the lid, interengage when the cover is pressed down. The elements having head portions wider than the base portions, so that when interengaged, they may not be separated without stressing or distorting the material.

10 Claims, 10 Drawing Figures

CONTAINER AND LID OF MOLDED PLASTIC MATERIAL

Applicant has invented a paint can and lid of molded plastic material with an interengaging structure which fastens the lid on the can to seal the can and to withstand the shocks of handling and transporting the cans of paint. The fastener structure, which is molded into the can and lid, acts to exert pressure between the lid and can to seal the can, and is readily engaged and disengaged to apply and remove the lid as necessary.

The advantages of synthetic plastic containers for paint have been recognized, as there is no danger of contamination of the contents. In metal cans which customarily have a tin coating, the base metal may be exposed if the coating is damaged, especially when the cover is removed and replaced, with consequent effect on the paint in contact with the base metal. This effect is avoided with the plastic container.

Plastic materials suitable for the present invention are thermoplastic resins which can be processed by injection molding. A preferred material for this structure would be high density polyethylene because of its memory, flexibility and resistance to certain chemicals such as acids and alkalis. These plastics also include polypropylene, ethylene-vinyl acetate copolymers, propylene-modified polyethylene, acetals, acrylonitrile-butadiene-styrene, polystyrene blends, chlorinated polyether, fluoro chemicals, polyamides, vinyls, and polyvinylidene chloride. These resins can have fibrous reinforcement which gives greater impact, tensil and flexural strength. The choice of the materials and fillers used must satisfy the requirements that they have the necessary resilience or pliability for the action of the fasteners.

The fastener structure to secure the lid on the can includes endless peripheral series of complementary, interengaging fastener elements on the lid and can body formed to interengage to prevent removal of the lid and also to create axial and lateral pressure between the lid and can to seal the can tightly.

The two complementary series of elements, one projecting axially upwardly on the wall of the can, the other downwardly on the rim of the lid, interengage when the cover is pressed down, the elements having their head portions wider than their base portions, so that when interengaged, they may not be separated without stressing or distorting the material. The material is sufficiently resilient or pliable that, when elements in the peripheral rows are engaged successively, the last one may be pressed into interengagement as a result of the resilience or pliability of the peripheral series of elements. These elements will then resist separation by force applied to the lid. However, if the force is concentrated at one point, as by a prying tool, two or three elements at that point may be disengaged and the remaining elements separated.

The lid and can are further formed with peripheral contacting surfaces to seal the can. For this purpose, the can is provided with an inclined internal surface on its wall and the lid has a peripheral flange extending downwardly, so that when the lid is pressed down, the flange on the lid will be wedged into the inclined surface on the wall.

The interengaging elements are provided with transversely inclined surfaces which interengage to produce a radial or lateral force between the can and lid, so that such force exerts pressure between engaging walls on the lid and can, thereby providing a tighter seal. In addition, the enlarged, intercalated heads have axially inclined side which exert axial pressure to maintain engagement and to seal contacting, peripheral transverse surfaces.

The peripheral fastener structure shown for fastening the cover on a can may be used wherever a peripheral interengaging fastener is required. Thus, two plastic tubes may be connected by a similar annular fastener structure. Fasteners of this type may also be used as two interengaging linear rows, each row being adjacent a wall engageable with a wall adjacent the other row of elements, so that the lateral wedging action of the laterally inclined surfaces of the elements will provide a sealing contact between the two walls. An additional feature is the provision of an interlocking engagement for cans on a shelf.

DRAWINGS

Figure 1:
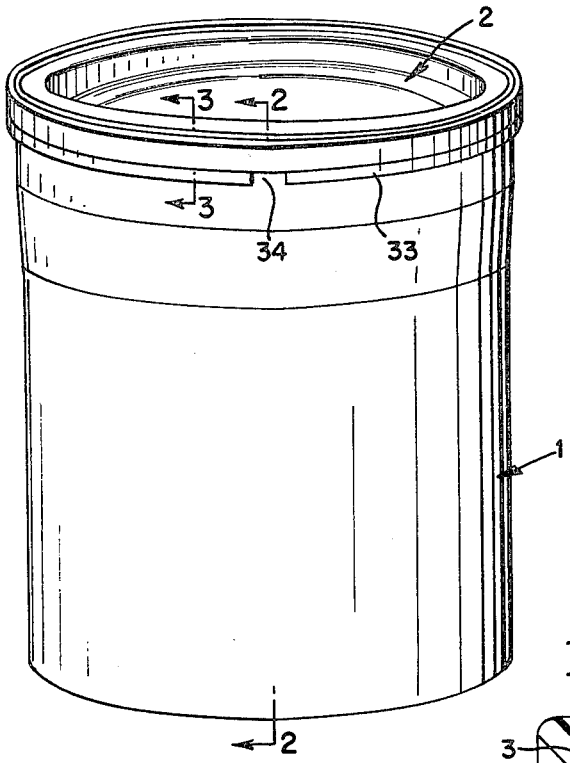
FIG. 1 is a view of the can with cover.

The terms "up", "down", "lower", "upper", etc., refer to a can standing upright, as seen in FIG. 1.

Figure 2:
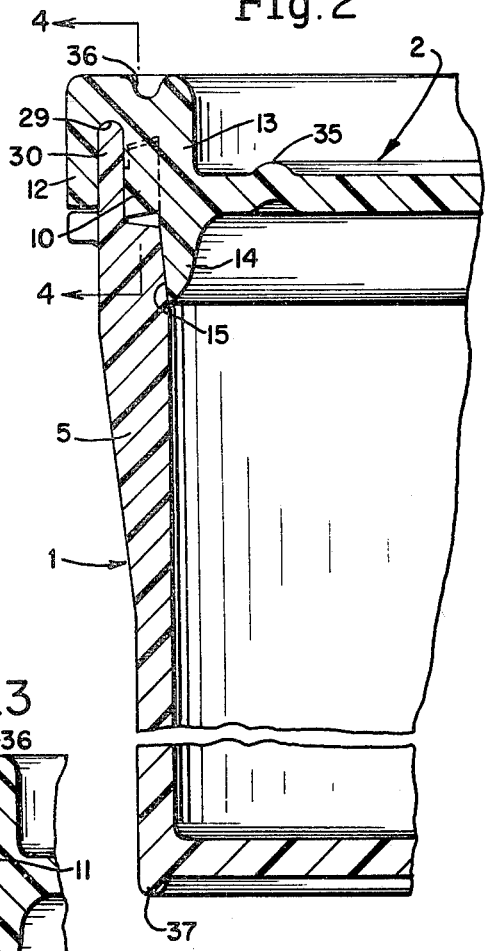
FIG. 2 is a section on line 2—2 of FIG. 1.
Figure 3:
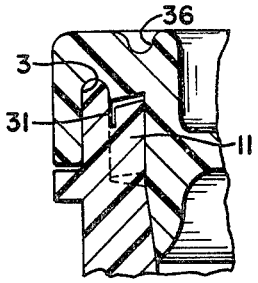
FIG. 3 is a fragmentary section of line 3—3 of FIG. 1.

In the first form of the invention in FIGS. 1 to 7, the lid 2 of the can 1 has a peripheral downwardly opening channel 3 which receives the upper edge of the wall 5 of the can, as shown in FIG. 2. Interengaging fastener elements 10 and 11 in the channel and on the wall, respectively, secure the lid on the can. The outer wall 12 of the channel in the lid fits over the outer wall of the can body, and the inner wall 13 has a downwardly extending flange 14 which is forced down within an inclined surface 15 on the can body, so that the flange 14 is in effect wedged into sealing contact with the wall of the can.

The two series of interengaging elements are formed with one series of upstanding elements 11 on the wall 5 of the can body and the other series of downwardly extending elements 10 in the channel 3 of the lid. The elements 10 on the wall are each formed with a head portion 20 of greater thickness peripherally than the base portion 21 to leave larger spaces between the base portions than between the head portions. The elements 10 in the channel of the lid are complementary to the first series, so that the head portions 22 of the lid elements may fit between the base portions 21 of the wall elements, with the heads 20 of the wall elements fitting between the base portions 23 of the lid elements and the sloping sides of the elements of the two series engaging to increase the axial pressure between the lid and can.

Figure 5:
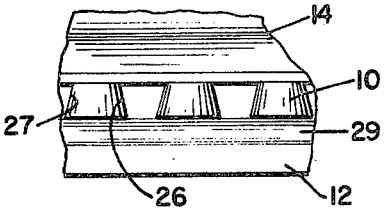
FIG. 5 is a fragmentary plan view of the fastener elements of the lid.
Figure 6:
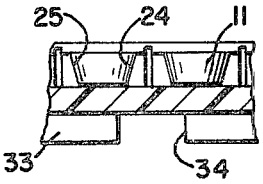
FIG. 6 is a fragmentary plan view of the fastener elements of the car body.
Figure 7:
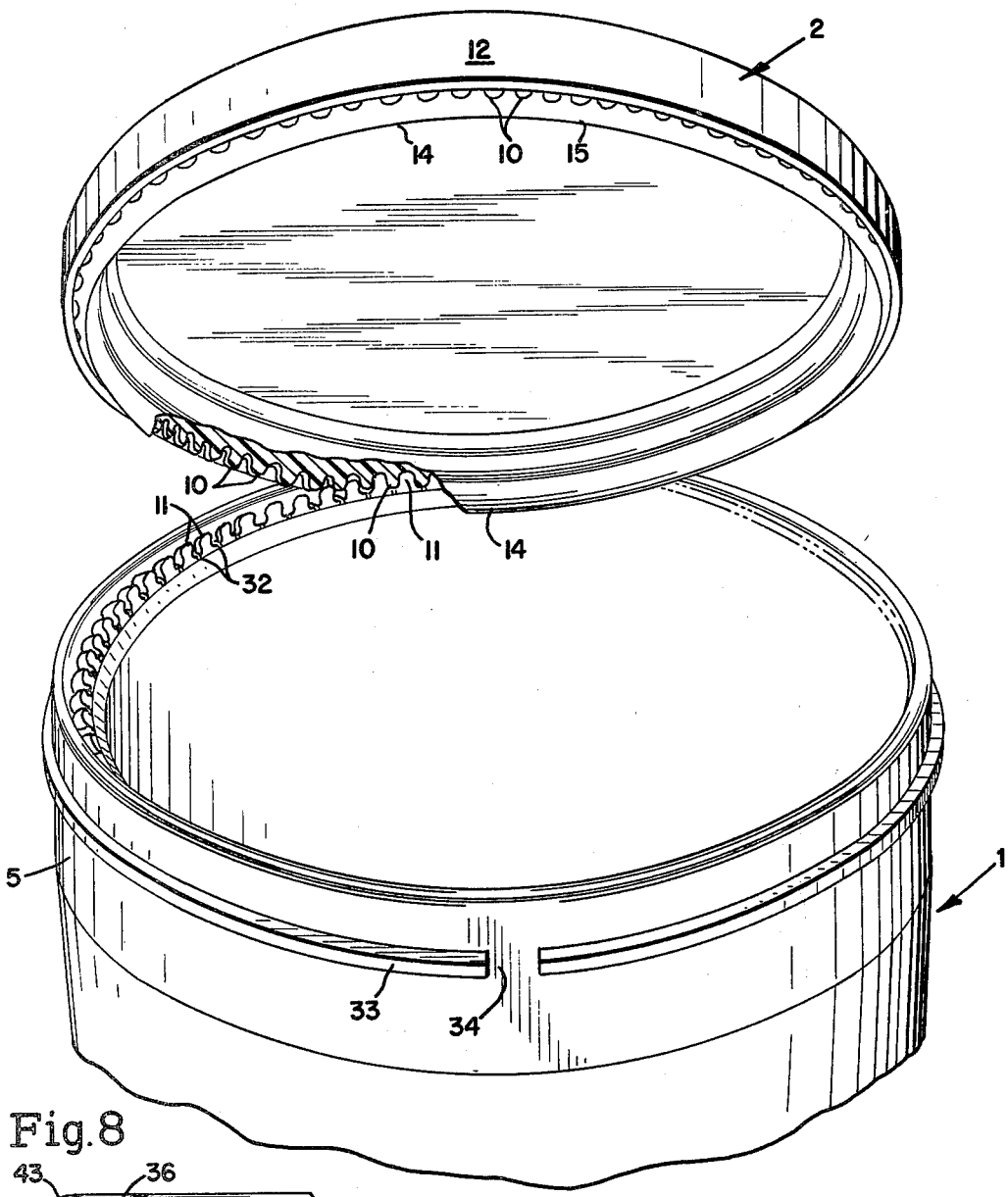
FIG. 7 is a perspective view of a can and lid, with the lid being applied to the can.

These elements 10 and 11 further have transversely inclined engaging surfaces as shown in plan views FIGS. 5 and 6. Thus in a top plan view the elements 11 on the body taper radially outwardly with inclined surfaces 24, 25, while the elements on the lid taper radially inwardly with inclined surfaces 26, 27, so that the two series of elements are wedged apart radially when the elements are engaged by pressing the lid onto the can.

Figure 4:
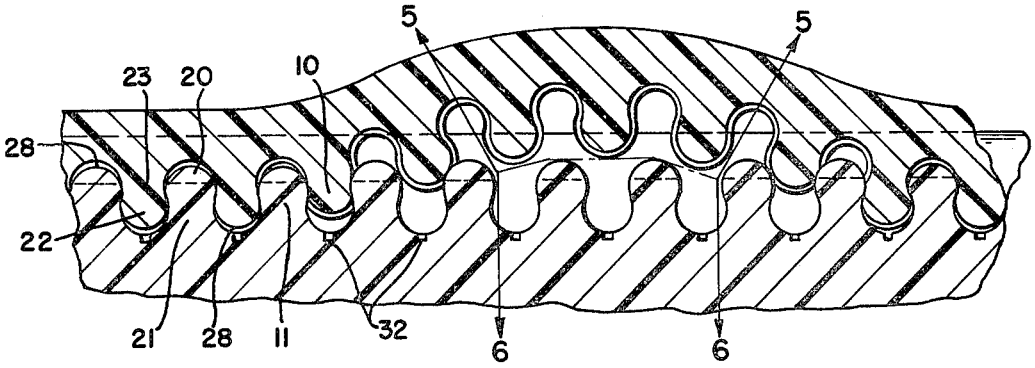
FIG. 4 is a section through the fastener formation on line 4—4 of FIG. 2.

The lid is applied to the can by starting at one side (see FIG. 7) to engage the fastener elements 10 on the lid between elements 11 on the wall of the can. The elements of both series are sufficiently pliable and elastic to be flexed as they successively interengage about the periphery, until the final closing elements are reached, as shown in FIG. 4. These may then be engaged by strong downward pressure, the peripheral series of elements and the material of the can and lid being sufficiently pliable and resilient to allow the final elements to interengage. As will be seen in FIG. 4, the head portions are slightly spaced from the opposite valleys at 28, so that the pressure on the lid is arrested by engagement of peripheral contacting surfaces such as those of the channel on the lid with the top edge 28 of the wall flange 30. The head portions 20 of elements 11 on the wall are also slightly spaced laterally from the wall body by the spaces 31 to allow greater flexure of these elements. The valleys between the elements on the wall have drains 32 at the bottom to allow any liquid to drain off from between the elements.

The outer side of the wall is provided with a circumferential rib 33 below its top edge to be engaged by the flange 12 on the lid. A notch 34 allows insertion of a prying tool to remove the lid. Upon force concentrated at one point, the interengaged elements at that point may be separated, the flexibility of the peripheral elements allowing separation of one or two elements. The lid also has a circumferential groove or fold 35 inwardly of the fastener formation to provide greater resilience and flexibility of the lid. The groove 36 adjacent the edge of the lid provides for stacking the cans by engaging a bead 37 on a can above.

Figure 8:
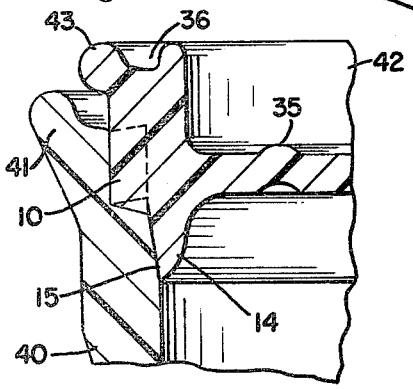
FIG. 8 is a sectional view of a second form of the invention.
Figure 9:
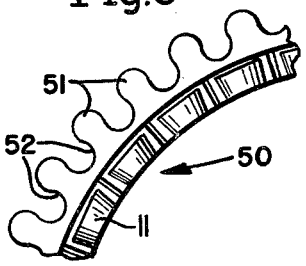
FIG. 9 is a fragmentary view of a modified can.
Figure 10:
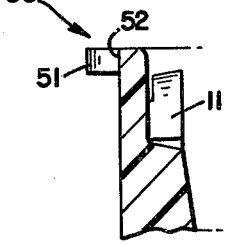
FIG. 10 is a section of the structure of FIG. 9.

In the second form, the rim formations on the wall 40 and lid 42 are modified as shown in FIG. 8. The series of fastener elements on the wall are formed on its inner side, as in the first form, but the wall is formed with a peripheral bead on its outer side, as at 41. The lid 42 also has fastener elements 10 to engage those on the wall, but the peripherally extending wall above the fastener elements has a bead 43, which is spaced from the bead 41 on the wall when the lid is fastened on the can. This space allows a prying tool to be inserted between the beads to pry off the lid. The fastener elements exert a radial force between the lid and can to maintain sealing engagement between the flange 14 on the lid and the wall surface 15 on the can.

Provision is made to interlock adjacent cans, as on a shelf, by forming the rims 50 on the cans with interengaging, radially extending projections. The projections of each rim have enlarged beads 51 which may fit into the spaces 52 between projections 51 on an adjacent can. These interlocking formations provide lateral stability and avoid the necessity for additional elements between the cans.

The fastener structure of this invention embodies series of interengaging elements which exert a force laterally of the series of fasteners to secure tight, sealing engagement between the members connected by the fasteners and also tightly secure the members in the direction of engagement of the elements. In the specific application shown, with peripheral series fastening two circumferential members, the plastic elements may be engaged successively to secure the two elements against separation, yet may be readily separated by a force applied at one point. These features contribute to sealing a can with a lid with sealing surfaces maintained in engagement with the fastener elements. In addition, the interlocking rims on the cans may be used to provide lateral stability.

I claim:

1. A container and lid of molded plastic material having a fastener structure integral with said container and lid to connect said lid onto said container, in which said lid has a peripheral channel facing the top edge of the wall of said container with the top edge of said wall in said channel, two peripheral series of similar complementary elements integral with the top edge of said wall and in said channel, each element being wider at its extremity in the peripheral direction than at its base adjacent its supporting member, so that the spaces between the elements are wider adjacent each of said members and are complementary to the elements, so that the interdigitated elements interlock against separation, the material of the members being sufficiently pliable for insertion and removal of at least one element from one series into space between elements of the other series when all remaining elements are interengaged, said elements of said two series having laterally inclined interengaging surfaces which act to apply force between said members radially of said container, said container and lid having continuous peripheral abutting surfaces and said laterally inclined surfaces on said elements applying force between said lid and container to press said abutting surfaces together tightly and seal said container.

2. A container and lid as claimed in claim 1, in which the channel on said lid has a radially inner wall and said channel wall extends downwardly toward the bottom of the container below the closure surface of said lid, and said wall of said container has an inclined surface below said fastener elements, the extended channel wall engaging said inclined wall to wedge said lid on said container and form a sealing surface for said container.

3. A fastener structure connecting two members of molded plastic material, one member having a peripheral channel and the other member having a peripheral wall equal in thickness to the width of said channel and with its edge extending into and fitting in said channel, two peripheral, continuous series of similar, complementary interdigitating elements on said wall and in said channel with the spaces between the elements complementary to said elements, the elements on said wall projecting from said wall into the channel, and the elements in the channel projecting toward the wall, each of said elements being wider at its extremity in the peripheral direction than at its base adjacent its supporting member, so that the spaces between the elements are wider adjacent each of said members and the interdigitated elements interlock against separation, the material of the members being sufficiently pliable for insertion or removal of at least one element from one series of elements into space between elements of the other series when all remaining elements are interengaged.

4. A fastener structure formed integrally with two molded plastic members, said members being formed with two integral series of complementary interdigitating elements and said members having transversely abutting surfaces adjacent said two series of elements, each of said interdigitating elements being wider at its extremity than at its base adjacent its supporting member to form wider spaces between elements adjacent the supporting member than at their extremities with inclined engaging surfaces on their contacting sides, so that said members will resist separation when interengaged, the elements of said two series also having their inclined laterally engaging surfaces to exert transverse force on said members and to press said abutting surfaces together to provide a seal between said two members.

5. A fastener structure for connecting two plastic members having internal and external telescoping walls, comprising two endless peripheral series of complementary interlocking elements on said telescoping walls, the elements of each series being wider at their outer head ends that at their bases, so that the heads of each series fit in the spaces between the bases of the complementary series, the width of the outer head ends of each series being greater than the distance between the heads, the resilience and pliability of said structures providing for interengagement of said two series by successive engagement of said elements and resisting separation of the series upon a direct pulling force, the sides of said elements being inclined so that the side surfaces of each element on the internal wall converge radially inwardly and the side surfaces of the elements on the external wall converge radially outwardly, so that pressure to engage said two series of elements produces a radial force to press said walls into tight engagement.

6. Two molded plastic members having peripheral telescoping walls and fastener structures on said walls to connect said members when said walls are telescoped together, said fastener structures comprising complementary, endless, continuous series of similar interdigitating elements projecting axially in the direction of telescoping movement of said walls, each series having one side integral with a facing side of one wall so that said two series interengage when the walls of said members are telescoped, each element of said series being narrow adjacent its base and widening toward its head at the opposite end, the spaces between said elements being of the shape of said elements, so that said spaces in one series receive the complementary elements of the interconnecting series, with the wider head portions of the elements of each series fitting into the widened spaces between the elements of the other series and with the sides of contacting elements of the two series inclined in the direction of telescoping movement so as to wedge each element between the two adjacent elements of the other series, said two series of elements being interengaged on telescoping movement by initial engagement of opposite elements on one side of said members and progressively engaging said two series of elements until the final elements are engaged due to the resilience and flexibility of the material of said members and said series of elements resist separation by the combined resistance to separation of all the interengaged elements, said walls having continuous, peripheral contacting surfaces relatively inclined in the direction of telescoping movement so that the contacting surfaces will be forced into tight engagement by telescoping movement and be held in sealing engagement by said fastener structures.

7. Two molded plastic members having peripheral, telescoping walls and fastener structures on said walls to connect said members when said walls are telescoped together, said fastener structures comprising complementary, endless, continuous series of similar interdigitating elements projecting axially in the direction of telescoping movement of said walls, each series having one side integral with a facing side of one wall so that said two series interengage when the walls of said members are telescoped, each element of said series being narrow adjacent its base and widening toward its head at the opposite end, the spaces between said elements being of the shape of said elements, so that said spaces in one series receive the complementary elements of the interconnecting series, with the wider head portions of the elements of each series fitting into the widened spaces between the elements of the other series and with the sides of contacting elements of the two series inclined in the direction of telescoping movement so as to wedge each element between the two adjacent elements of the other series, said two series of elements being interengaged on telescoping movement by initial engagement of opposite elements on one side of said members and progressively engaging said two series of elements until the final elements are engaged due to the resilience and flexibility of the material of said members and said series of elements resist separation by the combined resistance to separation of all the interengaged elements, the sides of each element being inclined transversely of the series of fasteners with the sides of each element on the radially outer wall converging outwardly and the sides of each element on the radially inner wall diverging outwardly, so that interengagement of the two series of elements presses the inner wall outwardly into tight contact with the outer wall.

8. Two molded plastic members having peripheral telescoping walls and fastener structures on said walls to connect said members when said walls are telescoped together, said fastener structures comprising complementary, endless, continuous series of similar interdigitating elements projecting axially in the direction of telescoping movement of said walls, each series having one side integral with a facing side of one wall so that said two series interengage when the walls of said members are telescoped, each element of said series being narrow adjacent its base and widening toward its head at the opposite end, the spaces between said elements being of the shape of said elements, so that said spaces in one series receive the complementary elements of the interconnecting series, with the wider head portions of the elements of each series fitting into the widened spaces between the elements of the other series and with the sides of contacting elements of the two series inclined in the direction of telescoping movement so as to wedge each element between the two adjacent elements of the other series, said two series of elements being interengaged on telescoping movement by initial engagement of opposite elements on one side of said members and progressively engaging said two series of elements until the final elements are engaged due to the resilience and flexibility of the material of said members and said series of elements resist separation by the combined resistance to separation of all the interengaged elements, each of said elements having its side integral with the wall at its base, with its widened head portion separated from said wall, so that greater flexibility is provided for interengaging said elements.

9. Two molded plastic members having fastener structures as claimed in claim 7, the spaces between the elements on the wall having grooves in the bottom of said spaces to allow liquid to escape.

10. Two molded plastic members having fastener structures as claimed in claim 7, said members having peripheral, laterally extending, spaced rims to allow a tool to be inserted between said members for separating said fastener elements.

* * * * *